US008521541B2

(12) United States Patent
Yi et al.

(10) Patent No.: US 8,521,541 B2
(45) Date of Patent: Aug. 27, 2013

(54) ADAPTIVE AUDIO TRANSCODING

(75) Inventors: Xiaoquan Yi, Mountain View, CA (US); Huisheng Wang, Palo Alto, CA (US); Vijnan Shastri, Mountain View, CA (US)

(73) Assignee: Google Inc., Mountain View, CA (US)

( * ) Notice: Subject to any disclaimer, the term of this patent is extended or adjusted under 35 U.S.C. 154(b) by 308 days.

(21) Appl. No.: 12/917,688

(22) Filed: Nov. 2, 2010

(65) Prior Publication Data

US 2012/0109643 A1 May 3, 2012

(51) Int. Cl.
*G10L 19/02* (2006.01)

(52) U.S. Cl.
USPC ..... 704/501; 704/201; 704/229

(58) Field of Classification Search
None
See application file for complete search history.

(56) References Cited

U.S. PATENT DOCUMENTS

| | | | | |
|---|---|---|---|---|
| 6,134,518 | A * | 10/2000 | Cohen et al. | 704/201 |
| 6,308,222 | B1 | 10/2001 | Krueger et al. | |
| 7,469,209 | B2 * | 12/2008 | Chong-White et al. | 704/229 |
| 8,285,403 | B2 * | 10/2012 | Salvatore et al. | 700/94 |
| 2004/0002855 | A1 | 1/2004 | Jabri et al. | |
| 2004/0267525 | A1 * | 12/2004 | Lee et al. | 704/208 |
| 2009/0006104 | A1 * | 1/2009 | Sung et al. | 704/500 |
| 2009/0037180 | A1 * | 2/2009 | Kim et al. | 704/500 |
| 2009/0125315 | A1 * | 5/2009 | Koishida et al. | 704/503 |
| 2010/0083344 | A1 | 4/2010 | Schildbach et al. | |
| 2010/0158098 | A1 | 6/2010 | McSchooler et al. | |
| 2011/0016231 | A1 * | 1/2011 | Ramaswamy et al. | 709/246 |
| 2011/0035213 | A1 * | 2/2011 | Malenovsky et al. | 704/208 |
| 2011/0202337 | A1 * | 8/2011 | Fuchs et al. | 704/231 |
| 2011/0238425 | A1 * | 9/2011 | Neuendorf et al. | 704/500 |

OTHER PUBLICATIONS

Makinin et al., "AMR-WB+: A new audio coding standard for 3rd generation mobile audio services", Acoustics, Speech, and Signal Processing, 2005. Proceedings. (ICASSP '05). IEEE International Conference on, Nokia Research Center, vol. 2, p. ii/1109-ii/1112 vol. 2 (2005).*

PCT International Search Report and Written Opinion, PCT/US2011/058714, Feb. 29, 2012, 8 pages.

* cited by examiner

*Primary Examiner* — Brian Albertalli
(74) *Attorney, Agent, or Firm* — Fenwick & West LLP

(57) ABSTRACT

A system and method provide an audio/video coding system for adaptively transcoding audio streams based on content characteristics of the audio streams. An audio stream metadata extraction module of the system is configured to extract metadata of a source audio stream. An audio stream classification module of the system is configured to classify the source audio stream into one of the several audio content categories based on the metadata of the source audio stream. An adaptive audio encoder of the system is configured to determine one or more transcoding parameters including target bitrate and sampling rate based on the metadata and classification of the source audio stream. An adaptive audio transcoder of the system is configured to transcode the source audio stream into an output audio stream using the transcoding parameters.

24 Claims, 3 Drawing Sheets

ADAPTIVE AUDIO TRANSCODING

BACKGROUND OF THE INVENTION

The present invention relates generally to audio/video hosting systems, and more particularly to an audio transcoding system for adaptive transcoding of audio streams based on audio stream content characteristics.

Background

Multimedia content hosting services, such as YOUTUBE, allow users to post videos along with their corresponding audio streams. An audio stream may be in one of numerous audio file formats, including FLAC, WAV, MP3, AAC, OGG, etc., compressed or uncompressed. Most media content hosting services transcode a source audio stream from its native format (e.g., FLAC) into a file format (e.g., WAV) requested by a client playback device. Audio transcoding of an audio stream may also comprise reducing the bitrate of the audio stream, reducing the sampling rate of the audio stream, compressing the audio stream, reducing the number of audio channels represented by the audio data, or the combination of these procedures. Transcoding can be used to reduce storage requirements, and also to reduce the bandwidth requirements for serving the audio streams to clients.

One challenge in designing an audio transcoding system for multimedia hosting services with millions of audios is to transcode and to store the audios with a balanced trade-off between acceptable sound quality and reduced bitrate. Conventional audio transcoding systems use a fixed target bitrate and/or a fixed sampling rate to transcode multiple audio streams regardless the varying content characteristics of the audio streams. However, given a large audio corpus, audio streams vary in terms of bitrate, sampling rate, number of channels and content complexity (e.g., music or speech). Coding each audio stream with same target bitrate and sampling rate does not necessarily produce acceptable sound quality in every case. A same target bitrate applied to two audio streams having different content characteristics leads to different sound qualities. Using a fixed target bitrate to encode audio streams with varying content characteristics deteriorates sound quality processed by a conventional audio transcoding system for multimedia hosting services.

SUMMARY

A method, system and computer program product provides adaptive transcoding of audio streams based on the audio content characteristics of audio streams for multimedia hosting services.

In one embodiment, the adaptive audio transcoding method receives a source audio stream for transcoding. The adaptive audio transcoding method extracts the metadata of the source audio stream, where the metadata of the source audio stream describes the audio content characteristics of the source audio stream. The adaptive audio transcoding method classifies the source audio stream into one of several audio content categories based a confidence score of the source audio stream. The audio content categories represent a semantic aspect of the audio content, using categories such as speech, music, movies, or even musical genre. A higher confidence score of the source audio stream indicates a higher probability that the source audio stream is a particular type, e.g., a speech audio stream. The adaptive audio transcoding method determines the transcoding parameters of the source audio stream, e.g., target bitrate and target sampling rate, based on the metadata and the classification of the source audio stream. The adaptive audio transcoding method transcodes the source audio stream using the transcoding parameters and outputs the transcoded audio stream.

In another embodiment, the adaptive audio transcoding system comprises an audio stream metadata extraction module, an audio stream classification module, an adaptive audio encoder and an adaptive audio transcoder. The audio stream metadata extraction module is configured to extract metadata of an audio stream, and the metadata describes the audio content characteristics of the audio stream. The audio stream classification module is configured to classify the audio stream based on the extracted metadata. The adaptive audio encoder is configured to determine the audio transcoding parameters, e.g., target bitrate and sampling rate, based on the extracted metadata and classification. The adaptive audio transcoder is configured to transcode the audio stream using the audio transcoding parameters.

The features and advantages described in the specification are not all inclusive and, in particular, many additional features and advantages will be apparent to one of ordinary skill in the art in view of the drawings, specification, and claims. Accordingly, this specification is intended to be illustrative, but not limiting, of the scope of the invention, which is set forth in the claims, below.

The figures depict various embodiments of the present invention for purposes of illustration only, and the invention is not limited to these illustrated embodiments. One skilled in the art will readily recognize from the following discussion that alternative embodiments of the structures and methods illustrated herein may be employed without departing from the principles of the invention described herein.

DETAILED DESCRIPTION

I. System Overview

Figure 1:
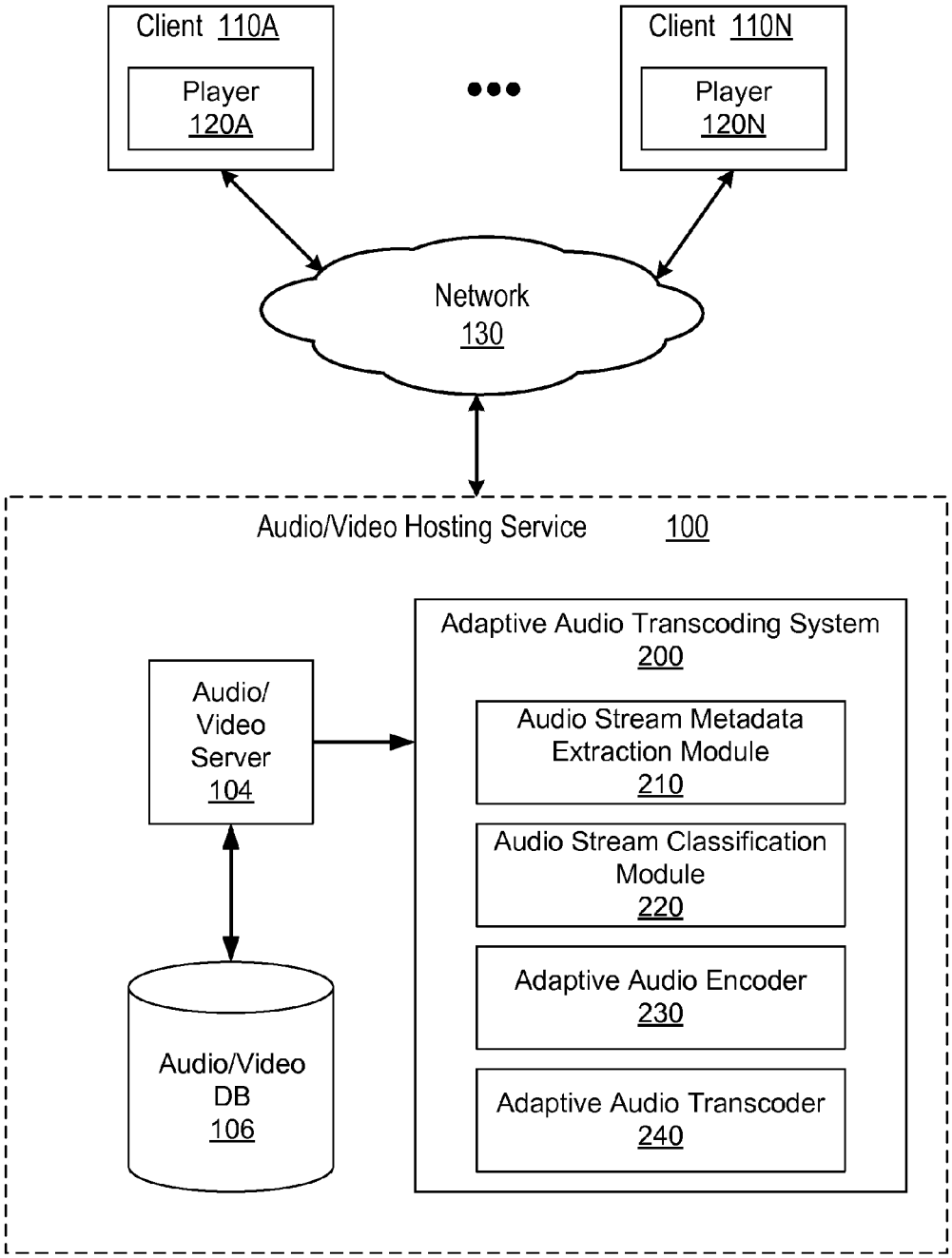
FIG. 1 is a block diagram illustrating a system view of an audio/video hosting service having an adaptive audio transcoding system.

FIG. 1 is a block diagram illustrating a system view of an audio/video hosting service 100 having an adaptive audio transcoding system 200. Multiple users/viewers use clients 110A-N to send audio/video hosting requests to the audio/video hosting service 100, such as uploading videos with their associated audio streams to a video hosting website, and receive the requested services from the audio/video hosting service 100. The audio/video hosting service 100 communicates with one or more clients 110 via a network 130. The audio/video hosting service 100 receives the audio/video hosting service requests from clients 110, transcodes source audio streams by the adaptive audio transcoding system 200 and returns the transcoded source audio streams to the clients 110.

Turning to the individual entities illustrated on FIG. 1, each client 110 is used by a user to request audio/video hosting services. For example, a user uses a client 110 to send a request for uploading a video and its associated audio stream for sharing, or playing a video with its associated audio stream. The client 110 can be any type of computer device, such as a personal computer (e.g., desktop, notebook, laptop)

computer, as well as devices such as a mobile telephone, personal digital assistant, IP enabled video player. The client 110 typically includes a processor, a display device (or output to a display device), a local storage, such as a hard drive or flash memory device, to which the client 110 stores data used by the user in performing tasks, and a network interface for coupling to the system 100 via the network 130.

A client 110 also has an audio/video player 120 (e.g., the Flash™ player from Adobe Systems, Inc., or a proprietary one) for playing a video stream with its associated audio stream. The audio/video player 120 may be a standalone application, a plug-in to another application such as a network browser, or a natively supported feature of the client's operating system/environment. Where the client 110 is a general purpose device (e.g., a desktop computer, mobile phone), the player 120 is typically implemented as software executed by the computer. Where the client 110 is dedicated device (e.g., a dedicated audio/video player), the player 120 may be implemented in hardware, or a combination of hardware and software. All of these implementations are functionally equivalent in regards to the present invention. The player 120 includes user interface controls (and corresponding application programming interfaces) for selecting an audio feed, starting, stopping, and rewinding an audio feed. Also, the player 120 can include in its user interface an audio channels selection configured to indicate how many audio channels are used to play back the audio stream (e.g., a single-channel monophonic sound or a multi-channel stereophonic sound). Other types of user interface controls (e.g., buttons, keyboard controls) can be used as well to control the playback and audio channels selection functionality of the player 120.

The network 130 enables communications between the clients 110 and the audio/video hosting service 100. In one embodiment, the network 130 is the Internet, and uses standardized internetworking communications technologies and protocols, known now or subsequently developed that enable the clients 110 to communicate with the audio/video hosting service 100.

The audio/video hosting service 100 comprises an adaptive audio transcoding system 200, an audio/video server 104 and an audio/video database 106. The audio/video server 104 receives user uploaded audios/videos and stores the audios/videos in the audio/video database 106. The audio/video server 104 also serves the audios/videos from the audio/video database 106 in response to user audio/video hosting service requests. The audio/video database 106 stores user uploaded audio files and audio files transcoded by the adaptive audio transcoding system 200. The service 100 may be implemented using a single computer, or a network of computers, including cloud-based computer implementations. The computers are preferably server class computers including one ore more high-performance CPUs and 1 G or more of main memory, as well as 500 Gb to 2 Tb of computer readable, persistent storage, and running an operating system such as LINUX or variants thereof. The operations of the service 100 as described herein can be controlled through either hardware or through computer programs installed in computer storage and executed by the processors of such servers to perform the functions described herein. The service 100 includes other hardware elements necessary for the operations described here, including network interfaces and protocols, input devices for data entry, and output devices for display, printing, or other presentations of data.

The adaptive audio transcoding system 200 comprises an audio stream metadata extraction module 210, an audio stream classification module 220, an adaptive audio encoder 230 and an adaptive audio transcoder 240. For a source audio stream, the audio stream metadata extraction module 210 extracts audio stream information. This audio stream information is referred to as "metadata of the source audio stream," and metadata of a source audio stream describes the audio content characteristics of the source audio stream, e.g., the semantic type of audio content. The audio stream classification module 220 classifies the source audio stream into one of several audio content categories of audio streams based on the metadata of the source audio stream; the audio content categories can include for example, speech and music or other semantically interesting types of content. In this regard then the audio content category is distinct from other metadata that is descriptive of the format of the audio content, such as its file type, encoder type, or the like. The adaptive audio encoder 230 determines audio coding parameters based on the metadata and classification of the source audio stream. The adaptive audio transcoder 240 transcodes the source audio stream using the determined transcoding parameters. As a beneficial result, each source audio stream is transcoded with reduced bitrate while maintaining its good sound quality.

In this description, the term "module" refers to computational logic for providing the specified functionality. A module can be implemented in hardware, firmware, and/or software. It will be understood that the named modules described herein represent one embodiment of the present invention, and other embodiments may include other modules. In addition, other embodiments may lack modules described herein and/or distribute the described functionality among the modules in a different manner. Additionally, the functionalities attributed to more than one module can be incorporated into a single module. Where the modules described herein are implemented as software, the module can be implemented as a standalone program, but can also be implemented through other means, for example as part of a larger program, as a plurality of separate programs, or as one or more statically or dynamically linked libraries. In any of these software implementations, the modules are stored on the computer readable persistent storage devices of the service 100, loaded into memory, and executed by the one or more processors of the service's computers. The operations of the system 200 and its modules will be further described below with respect to FIG. 2 and the remaining figures.

II. Adaptive Audio Transcoding

Varying content characteristics in audio streams lead to various amount of information contained in the audio streams. Given a large audio corpus of an audio/video hosting service, coding each audio stream with a fixed target bitrate and/or a fixed sampling rate does not necessarily produce acceptable sound quality in every case. Applying same target bitrate to audio streams having different content characteristics leads to different sound qualities. A target bitrate being applied to a speech audio stream may produce a good sound quality. Applying the same target bitrate to a music audio stream may result in poor sound quality due to the complex audio content to be coded. Ignoring the impact of audio content characteristics and coding complexity on transcoding an audio stream degrades the sound quality of the transcoded audio and user experience. To transcode an audio stream with acceptable sound quality needs to effectively adjust the target bitrate and/or sampling rate to be used based on the content characteristics of the source audio stream.

Figure 2:
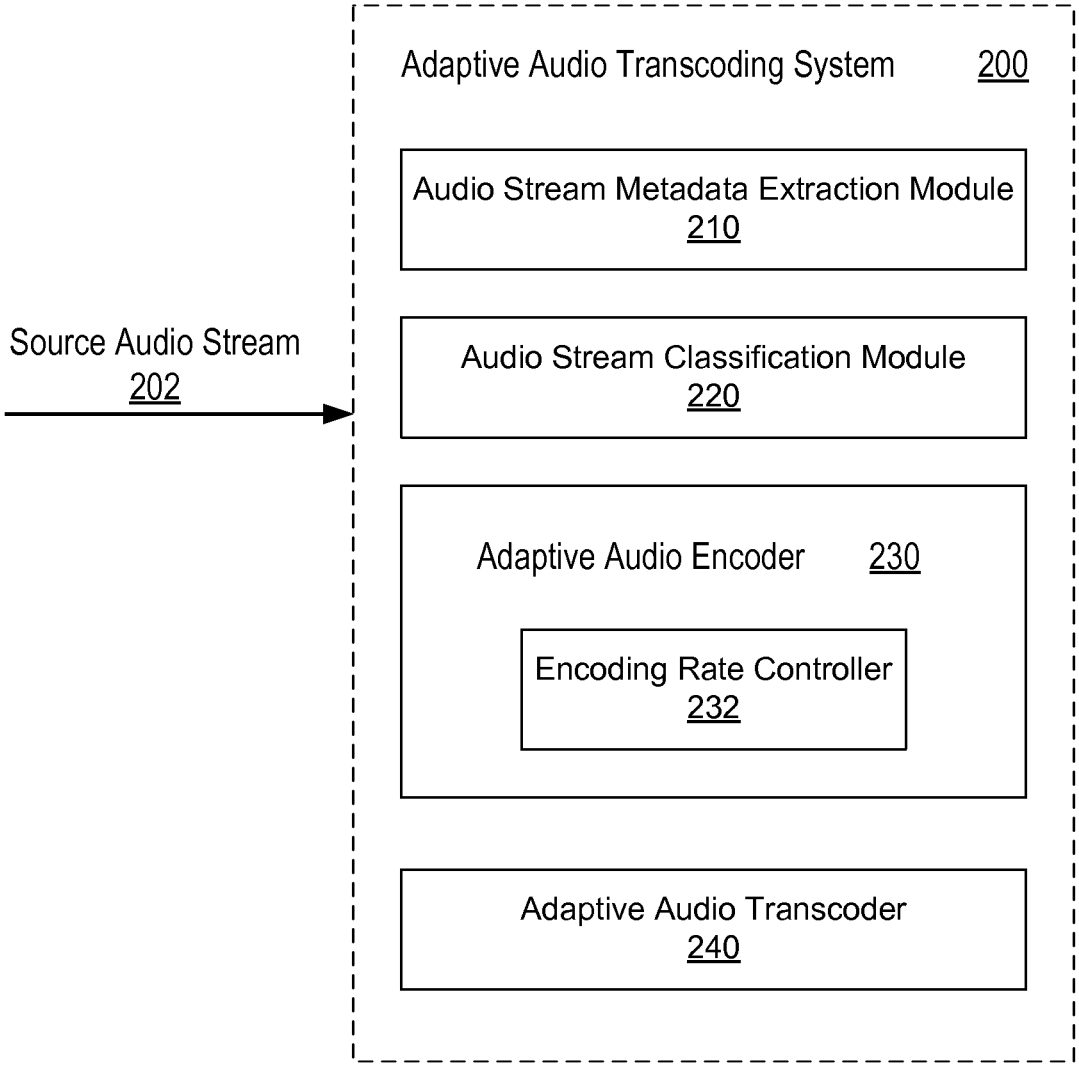
FIG. 2 is a block diagram of functional modules of an adaptive audio transcoding system.

FIG. 2 is a block diagram of functional modules of the adaptive audio transcoding system 200 illustrated in FIG. 1. The adaptive audio transcoding system 200 comprises an audio stream metadata extraction module 210, an audio stream classification module 220, an adaptive audio encoder 230 and an adaptive audio transcoder 240. The adaptive audio transcoding system 200 receives a source audio 202 stream, and transcodes the source audio 202 using a target bitrate and sampling rate determined by the functional modules of the transocding system 200.

The audio stream metadata extraction module 210 is configured to extract metadata of the source audio stream 202, and is one means for performing this function. The metadata of the source audio stream 202 describes the content characteristics of the source audio stream 202. For example, the metadata of the source audio stream 202 may include the following parameters of the source audio stream 202:

audio_codec_id: identification of the audio encoder/decoder used to compress the source audio stream;

audio_bitrate: bitrate used to encode the source audio stream;

audio_sample_rate: sampling rate used to encode the source audio stream;

audio_channels: number of channels to represent the source audio stream;

audio_frame_size: size of an audio frame of the source audio stream;

num_audio_stream: number of embedded audio streams in the source audio stream;

audio_num_of_frames: number of audio frames in the source audio stream;

audio_confidence_score: confidence score of the source audio stream;

The audio stream classification module 220 is configured to classify the source audio stream 202 into one of several audio content categories, and is one means for performing this function. Classification of an audio stream further indicates the content characteristics of the audio stream besides its metadata, and the audio classification can be used by the adaptive audio transcoding system 200 to adjust target bitrate and sampling rate for transcoding the audio stream. In one embodiment, the audio content categories include semantically useful categories such as music and speech. The audio stream classification module 220 classifies an audio stream based on its confidence score. The confidence scores range from 0 to 1.0 and a higher confidence score indicates that the audio stream is more likely to be a speech audio stream. For example, a confidence score approaching 1 for an audio stream indicates that the audio stream is most likely a speech audio stream. In another example, a confidence score approaching 0 for an audio stream indicates that the audio stream is most likely a music audio stream. Of course, in other embodiment, the operation of the classification module can be configured to make a score of 1 indicative of music, and a score of 0 indicative of speech.

Given a confidence score of the source audio stream 202, the audio stream classification module 220 compares the confidence score with a threshold value. If the confidence score is larger than or is equal to the threshold value, the audio stream classification module 220 classifies the source audio stream 202 as a speech audio stream. A source audio stream with a confidence score smaller than the threshold value is classified as a music audio stream. In one embodiment, the threshold value is set to a default value of 0.6. The audio content stream categories may include other audio content categories such as movies which is the combination of music and speech, or genres of music, such as classical, rock, jazz, acoustic, and so forth. The combination of music and speech can be further categorized as overlapping and non-overlapping. In the overlapping case, music of a source audio stream has precedence over speech for the audio stream. In the non-overlapping case, the music-speech classification can be extended in a more granular fashion. For example, for a source audio stream of 100 seconds duration, the first 50 seconds is for speech, 51-75 seconds for music and the last 25 seconds for speech again. Other audio stream categories may include noise and silence.

To further illustrate the audio stream classification of the audio stream classification module 220, the following pseudo-code represents one embodiment of the audio stream classification described above:

```
//audio stream classification//
if (audio__confidence__socre ≧ conf__threshold)
{
        audio__stream = SPEECH;
}
else
{
        audio__stream = MUSIC.
}
```

The audio_stream variable thus stores a label, string or value which describes the content type or category. The variable can be a semantically useful label such as MUSIC or simply a code value ("1") that is linked to the label or category name.

The adaptive audio encoder 230 is configured to determine audio transcoding parameters of the source audio stream 202 based on the metadata and classification of the source audio stream 202, and is one means for performing this function. The audio transcoding parameters of a source audio stream include target bitrate, target sampling rate and other coding parameters for transcoding the source audio stream. To simplify the description of the adaptive audio encoder 230, the bitrate and sampling rate of the source audio stream 202 before transcoding are referred to as input bitrate and input sampling rate, respectively. In the embodiment illustrated in FIG. 2, the adaptive audio encoder 230 comprises an audio encoding rate controller 232 configured to store and update audio transcoding parameters.

In one embodiment, the adaptive audio encoder 230 determines the target bitrate by linearly scale the input bitrate and input sample rate of the source audio stream 202 within the allowable range of the bitrate and sampling rate of the source audio stream 202. Specifically, the audio encoder 203 obtains the maximum and minimum values of the bitrate and sampling rate of the source audio stream 202 from the audio encoding rate controller 232. The maximum and minimum values of bitrate and sampling rate of the source audio stream define the allowable range of bitrate and sampling rate to be used to transcode the source audio stream 202. For example, for CD-type audio streams, the typical sampling rate is 44.1 kHz. The maximum and minimum values of the bitrate and sampling rate of an audio stream may be pre-defined or based on industrial standards that are known to those of ordinary skills in the art.

To further illustrate the linear scaling of the adaptive audio encoder 203, the following pseudo-code represents one embodiment of obtaining the pairs of maximum and minimum values of the bitrate and sampling rate of the source audio stream 202:

```
//obtaining allowable bitrate and smapling rate//
const int sample__rate__min=
enc__options.ratecontrol( ).sample__rate__min( );
const int sample__rate__max=
```

-continued

```
enc__options.ratecontrol( ).sample__rate__max( );
const int bitrate__min= enc__options.ratecontrol( ).bitrate__min( );
const int bitrate__max= enc__options.ratecontrol( ).bitrate__max( );
```

After obtaining the maximum and minimum values of the bitrate and sampling rate of the source audio stream 202, the adaptive audio encoder 230 determines the target bit rate by linearly scaling the input bitrate and input sample rate of the source audio stream 202 using the equation (1) below:

$$\text{target_bitrate} = \text{bitrate_min} + \frac{(\text{bitrate_max} - \text{bitrate_min}) * (\text{sample_rate} - \text{sample_rate_min})}{(\text{sample_rate_max} - \text{sample_rate_min})}. \quad (1)$$

The target bitrate of the source audio stream 202 can be further adjusted based on the number of channels of the source audio stream 202. Generally, a monophonic audio stream (i.e., have one audio channel) requires less bits to encode the audios stream than a multi-channel stereophonic audio stream. The adaptive audio encoder 230 can adjust the target bitrate calculated by the equation (1) based on the number of channels, e.g., audio_channels, of the source audio stream 202 using the equation (2) below:

$$\text{target_bitrate} = \text{target_bitrate} * \alpha, \quad (2)$$

where $\alpha$ is the scaling factor. For example, if the source audio stream 202 has one audio channel, i.e., audio_channels=1, the scaling factor is set to 0.8, i.e., $\alpha=0.8$.

The adaptive audio encoder 230 can further adjust the target bitrate of the source audio stream 202 based on the classification of the source audio stream 202. Adjustment based on audio classification allows the adaptive audio encoder 230 to determine a more context-aware target bitrate for the source audio stream 202. For example, a music audio stream generally requires more bits to encode the stream in order to maintain an acceptable sound quality than a speech audio stream. The adaptive audio encoder 230 obtains the confidence score of the source audio stream 202, and adjusts the target bitrate according to the equation (3) below:

$$\text{target_bitrate} = \text{target_bitrate} * \text{multiplier}, \quad (3)$$

where $$\text{multiplier} = \frac{\overline{\omega}}{s^{\beta}},$$

and $\overline{\omega}=0.4$, $\beta=0.3$ and s is the confidence score (i.e, audio_confidence_score) of the source audio stream 202.

To avoid having a target bitrate beyond the allowable values for the source audio stream 202, the adaptive audio encoder 203 checks whether the calculated target bitrate is within the range of the maximum and minimum bitrates of the source audio stream 202. If the calculated target bitrate of the source audio stream is larger than the maximum bitrate, the target bitrate is set to be equal to the maximum bitrate. If the calculated target bitrate of the source audio stream is smaller than the minimum bitrate, the target bitrate is set to be equal to the minimum bitrate.

Using the maximum and minimum values of the bitrate of the source audio stream 202 described above, the following pseudo-code represents one embodiment of checking the target bitrate against the maximum and minimum values of the bitrate of the source audio stream 202:

```
//sanity checking of the calculated target bitrate//
if (target__bitrate ≦ bitrate__min)
{
        target__bitrate = bitrate__min;
}
if (target__bitrate ≧ bitrate__max)
{
        target__bitrate = bitrate__max;
}
```

After determining the target bitrate of the source audio stream 202, the adaptive audio encoder 230 determines the corresponding target sampling rate of the source audio stream 202. To capture audio within the entire 20-20,000 Hz range of human hearing, an audio stream is typically sampled at 22 KHz for speech audio streams, or 44 KHz and above for general audio streams (e.g., music). The adaptive audio encoder 230 uses the audio stream classification information to determine the target sampling rate.

For example, the adaptive audio encoder 230 can use the same threshold value used to classify the source audio stream 202 to determine the target sampling rate. The following pseudo-code represents one embodiment of the target sampling rate determination:

```
//audio stream classification and target sampling rate determination//
if (audio__confidence__socre ≧ conf__threshold)
{
        audio__stream = SPEECH;
        target__sample__rate = 22050;
}
else
{
        audio__stream = MUSIC;
        target__sample__rate = 44100;
}
```

The adaptive audio transcoder 240 is configured to transcode the source audio stream 202 using the audio transcoding parameters determined by the adaptive audio encoder 230, and is one means for performing this function. Specifically, the adaptive audio transcoder 240 transcodes the source audio stream 202 in its native file format, input bitrate, input sampling rate into an output audio stream with the target bitrate and target sampling rate determined by the adaptive audio encoder 230. The output audio stream has an acceptable sound quality and conforms to the memory or other hardware configuration of the client for playback or the bandwidth of the communication link between the client 110 and the adaptive audio transcoding system 200. The adaptive audio transcoder 240 outputs the transcoded source audio stream to the audio/video hosting service 100 for the client 110 to playback.

Figure 3:
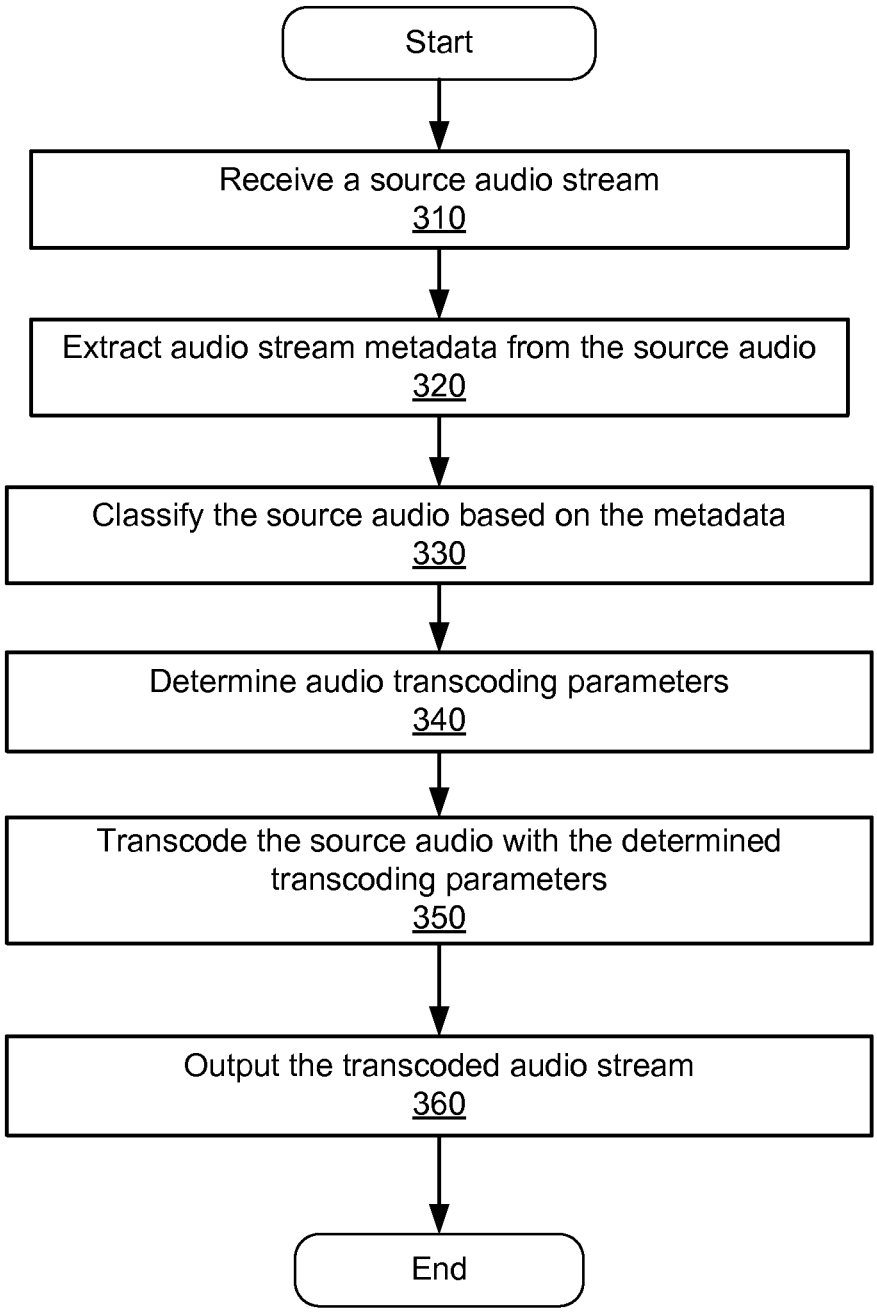
FIG. 3 is a flow chart of adaptively transocding an audio stream using the functional modules illustrated in FIG. 2.

Turning now to FIG. 3, FIG. 3 is a flow chart of adaptively transocding an audio stream using the functional modules illustrated in FIG. 2. Initially, the adaptive transcoding system 200 receives 310 a source audio stream for transcoding. The audio stream metadata extraction module 210 extracts 320 the metadata of the source audio stream. The metadata of the source audio stream describes the content characteristics of the source audio stream. The metadata of the source audio stream may include the input bitrate, input sampling rate, number of channels and confidence score. The audio stream classification module 220 classifies 330 the source audio stream into one of several audio categories based on the confidence score of the source audio stream. In one implementation, a higher confidence score of the source audio stream indicates a higher probability that the source audio stream is a particular type, e.g., a speech audio stream. The adaptive audio encoder 230 determines 340 the transcoding parameters of the source audio stream based on the metadata and the classification of the source audio stream. The transcoding parameters include the target bitrate and target sampling rate of the source audio stream. The target bitrate and target sampling rate are determined based on one or more of the input bitrate, input sampling rate, number of the channels, classification of the source audio stream or the combination of these metadata. The adaptive audio transcoder 240 receives the transcoding parameters of the source audio stream from the adaptive audio encoder 230 and transcodes 350 the source audio stream using the transcoding parameters. The adaptive audio transcoder 240 further outputs 360 the transcoded source audio stream to the audio/video hosting service 100 for the client 110 to playback.

The above description is included to illustrate the operation of the preferred embodiments and is not meant to limit the scope of the invention. The scope of the invention is to be limited only by the following claims. From the above discussion, many variations will be apparent to one skilled in the relevant art that would yet be encompassed by the spirit and scope of the invention.

The present invention has been described in particular detail with respect to one possible embodiment. Those of skill in the art will appreciate that the invention may be practiced in other embodiments. First, the particular naming of the components, capitalization of terms, the attributes, data structures, or any other programming or structural aspect is not mandatory or significant, and the mechanisms that implement the invention or its features may have different names, formats, or protocols. Further, the system may be implemented via a combination of hardware and software, as described, or entirely in hardware elements. Also, the particular division of functionality between the various system components described herein is merely exemplary, and not mandatory; functions performed by a single system component may instead be performed by multiple components, and functions performed by multiple components may instead performed by a single component.

Some portions of above description present the features of the present invention in terms of algorithms and symbolic representations of operations on information. These algorithmic descriptions and representations are the means used by those skilled in the data processing arts to most effectively convey the substance of their work to others skilled in the art. These operations, while described functionally or logically, are understood to be implemented by computer programs. Furthermore, it has also proven convenient at times, to refer to these arrangements of operations as modules or by functional names, without loss of generality.

Unless specifically stated otherwise as apparent from the above discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention could be embodied in software, firmware or hardware, and when embodied in software, could be downloaded to reside on and be operated from different platforms used by real time network operating systems.

The present invention also relates to an apparatus for performing the operations herein. This apparatus may be specially constructed for the required purposes, or it may comprise a general-purpose computer selectively activated or reconfigured by a computer program stored on a computer readable medium that can be accessed by the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and operations presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will be apparent to those of skill in the, along with equivalent variations. In addition, the present invention is not described with primary to any particular programming language. It is appreciated that a variety of programming languages may be used to implement the teachings of the present invention as described herein, and any reference to specific languages are provided for disclosure of enablement and best mode of the present invention.

The present invention is well suited to a wide variety of computer network systems over numerous topologies. Within this field, the configuration and management of large networks comprise storage devices and computers that are communicatively coupled to dissimilar computers and storage devices over a network, such as the Internet.

Finally, it should be noted that the language used in the specification has been principally selected for readability and instructional purposes, and is not intended to narrowly circumscribe the inventive subject matter.

What is claimed is:

1. A computer system for adaptively transcoding a source audio stream of an audio/video hosting service, the system comprising:

a computer processor configured to execute computer modules comprising:

an audio stream metadata extraction module configured to extract metadata of the source audio stream, the metadata of the source audio stream describing audio content characteristics of the source audio stream, the metadata of the source audio stream comprising a confidence score of the source audio stream, the confidence score of a source audio stream representing a probability of the source audio stream being a type of audio stream;

an audio stream classification module configured to classify the source audio stream into one of a plurality of audio content categories based on the confidence score of the source audio stream, the audio stream classification module coupled to the audio stream metadata extraction module;

an adaptive audio encoder configured to determine one or more transcoding parameters based on the metadata and classification of the source audio stream, the adaptive audio encoder coupled to the audio stream metadata extraction module and the audio stream classification module; and an adaptive audio transcoder configured to transcode the source audio stream to an output audio stream using the transcoding parameters, and the adaptive audio transcoder coupled to the adaptive audio encoder.

2. The system of claim 1, wherein the metadata of the source audio stream further includes an input target bitrate, an input sampling rate and number of audio channels.

3. The system of claim 1, wherein the plurality of audio content categories include speech and music.

4. The system of claim 1, wherein the audio stream classification module is further configured to compare the confidence score of the source audio stream with a predetermined confidence threshold.

5. The system of claim 1, wherein the adaptive audio encoder is further configured to determine a target bitrate based on the input bitrate and input sampling rate of the source audio stream.

6. The system of claim 5, wherein the adaptive audio encoder is further configured to linearly scale the input bitrate and input sampling rate of the source audio stream to determine the target bitrate.

7. The system of claim 6, wherein the adaptive audio encoder is further configured to adjust the target bitrate based on the number of channels of the source audio stream.

8. The system of claim 6, wherein the adaptive audio encoder is further configured to adjust the target bitrate based on the classification of the source audio stream.

9. The system of claim 6, wherein the adaptive audio encoder is further configured to adjust the target bitrate based on the number of channels and the classification of the source audio stream.

10. A method for adaptively transcoding a source audio stream of an audio/video hosting service, the method executed by a computer processor, and comprising:

receiving the source audio stream;

extracting metadata of the source audio stream, the metadata of the source audio stream describing audio content characteristics of the source audio stream, the metadata of the source audio stream comprising a confidence score of the source audio stream, the confidence score of a source audio stream representing a probability of the source audio stream being a type of audio stream;

classifying the source audio stream into one of a plurality of audio content categories based on the confidence score of the source audio stream;

determining one or more transcoding parameters based on the metadata and classification of the source audio stream; and transcoding the source audio stream to an output audio stream using the transcoding parameters.

11. The method of claim 10, wherein the metadata of the source audio stream further includes an input target bitrate, an input sampling rate and number of audio channels.

12. The method of claim 10, wherein the plurality of audio content categories include at least speech and music.

13. The method of claim 10, wherein classifying the source audio stream further comprises comparing the confidence score of the source audio stream with a predetermined confidence threshold.

14. The method of claim 10, wherein determining one or more transcoding parameters comprises determining a target bitrate based on the input bitrate and input sampling rate of the source audio stream.

15. The method of claim 14, wherein determining one or more transcoding parameters further comprises linearly scaling the input bitrate and input sampling rate of the source audio stream to determine the target bitrate.

16. The method of claim 15, wherein determining one or more transcoding parameters further comprises adjusting the target bitrate based on the number of channels of the source audio stream.

17. The method of claim 15, wherein determining one or more transcoding parameters further comprises adjusting the target bitrate based on the classification of the source audio stream.

18. The method of claim 15, wherein determining one or more transcoding parameters further comprises adjusting the target bitrate based on the number of channels and the classification of the source audio stream.

19. A computer program product having a non-transitory computer-readable storage medium having executable computer program instructions recorded thereon for adaptively transcoding a source audio stream of an audio/video hosting service, the computer program instructions configuring a computer system to comprise:

an audio stream metadata extraction module configured to extract metadata of a source audio stream, the metadata of the source audio stream describing audio content characteristics of the source audio stream, the metadata of the source audio stream comprising a confidence score of the source audio stream, the confidence score of a source audio stream representing a probability of the source audio stream being a type of audio stream;

an audio stream classification module configured to classify the source audio stream into one of a plurality of audio content categories based on the confidence score of the source audio stream, the audio stream classification module coupled to the audio stream metadata extraction module;

an adaptive audio encoder configured to determine one or more transcoding parameters based on the metadata and classification of the source audio stream, the adaptive audio encoder coupled to the audio stream metadata extraction module and the audio stream classification module; and an adaptive audio transcoder configured to transcode the source audio stream to an output audio stream using the transcoding parameters, and the adaptive audio transcoder coupled to the adaptive audio encoder.

20. The computer program product of claim 19, wherein the adaptive audio encoder is further configured to determine a target bitrate based on the input bitrate and input sampling rate of the source audio stream.

21. The computer program product of claim 20, wherein the adaptive audio encoder is further configured to linearly scale the input bitrate and input sampling rate of the source audio stream to determine the target bitrate.

22. The computer program product of claim 20, wherein the adaptive audio encoder is further configured to adjust the target bitrate based on the number of channels of the source audio stream.

23. The computer program product of claim 20, wherein the adaptive audio encoder is further configured to adjust the target bitrate based on the classification of the source audio stream.

24. The computer program product of claim 20, wherein the adaptive audio encoder is further configured to adjust the target bitrate based on the number of channels and the classification of the source audio stream.

* * * * *